US010286249B1

(12) United States Patent
Sibhatu

(10) Patent No.: US 10,286,249 B1
(45) Date of Patent: May 14, 2019

(54) EXERCISE VEST

(71) Applicant: Mussie T. Sibhatu, Oakland, CA (US)

(72) Inventor: Mussie T. Sibhatu, Oakland, CA (US)

( * ) Notice: Subject to any disclaimer, the term of this patent is extended or adjusted under 35 U.S.C. 154(b) by 0 days.

(21) Appl. No.: 15/232,550

(22) Filed: Aug. 9, 2016

(51) Int. Cl.

| | |
|---|---|
| ***A41D 1/04*** | (2006.01) |
| ***A63B 21/00*** | (2006.01) |
| ***A63B 21/04*** | (2006.01) |
| ***A63B 23/12*** | (2006.01) |
| ***A63B 21/055*** | (2006.01) |

(52) U.S. Cl.
CPC ..... *A63B 21/4007* (2015.10); *A41D 1/04* (2013.01); *A63B 21/00061* (2013.01); *A63B 21/0442* (2013.01); *A63B 21/0552* (2013.01); *A63B 21/0557* (2013.01); *A63B 23/12* (2013.01); *A41D 2300/322* (2013.01); *A41D 2300/33* (2013.01)

(58) Field of Classification Search
CPC ..... A63B 21/4001; A63B 21/4005; A63B 21/4025; A63B 21/00061; A63B 23/12; A63B 21/0552; A63B 21/0442; A63B 21/0557; A63B 21/04; A63B 21/065; A63B 21/4007–21/4009; A41D 1/04; A41D 2300/33; A41D 2300/322; B63C 9/11–9/1255
See application file for complete search history.

(56) References Cited

U.S. PATENT DOCUMENTS

| | | | | |
|---|---|---|---|---|
| 3,931,657 | A * | 1/1976 | Jones | B63C 9/115 441/116 |
| 5,152,706 | A * | 10/1992 | Fister | B63C 9/115 441/106 |
| 5,792,034 | A | 8/1998 | Kozlovsky | |
| D409,697 | S | 5/1999 | Ott | |
| 6,081,924 | A * | 7/2000 | Ott | A63B 21/065 2/102 |
| 6,659,921 | B2 | 12/2003 | Vernon | |
| 6,675,391 | B2 * | 1/2004 | Morrison | A63B 21/065 2/102 |
| 6,691,318 | B1 | 2/2004 | Davis | |
| 7,325,254 | B1 * | 2/2008 | Edgar | A63B 21/0004 2/102 |
| 8,595,862 | B2 * | 12/2013 | Storms, Jr. | A41D 13/05 2/102 |
| D732,118 | S * | 6/2015 | Hamilton | D21/662 |
| 2003/0125170 | A1 | 7/2003 | Vernon | |
| 2005/0282689 | A1 | 12/2005 | Weinstein | |
| 2006/0040805 | A1 | 2/2006 | Wilkinson | |

(Continued)

*Primary Examiner* — Jennifer M Deichl

(57) ABSTRACT

An exercise vest to exercise and tone targeted muscles of the upper body including a vest body having a zippered front side and a shoulder portion engageable to the rear side proximal the top side for arm hole size adjustment. A removable, washable liner is provided. Exercise resistance bands interchangeably clip onto a plurality of D-rings strategically disposed on each of the front and rear sides. Length-adjustable chest straps secure the right and left portions together and properly position the vest body for use. At least one side strap is disposed across a vertical channel disposed between each arm hole and a bottom side of the vest body, to adjust the width of the vest body to a user's chest size. A belt slidingly engaging belt loops secures the vest body in a proper position on the user and prevents the vest body from sliding upwardly during use.

7 Claims, 5 Drawing Sheets

(56) References Cited

U.S. PATENT DOCUMENTS

| | | | | |
|---|---|---|---|---|
| 2007/0083975 | A1* | 4/2007 | Senegal | A63B 21/0552 2/102 |
| 2013/0185851 | A1* | 7/2013 | Nilsen | F41H 1/02 2/463 |
| 2013/0276218 | A1* | 10/2013 | Parisi, Jr. | F41H 1/02 2/463 |
| 2015/0064998 | A1* | 3/2015 | Barr | B63C 9/11 441/106 |
| 2015/0065317 | A1* | 3/2015 | Washington | A63B 21/0442 482/124 |
| 2015/0374043 | A1* | 12/2015 | Dahl | A41D 1/04 2/102 |
| 2017/0266477 | A1* | 9/2017 | Cordero | A63B 21/0442 |

* cited by examiner

EXERCISE VEST

BACKGROUND OF THE INVENTION

Various types of exercise devices are known in the prior art. However, what is needed is an exercise vest provided to exercise and tone targeted muscles of the upper body for exercise by including D-rings strategically disposed on the front and rear sides of the vest body to which resistance bands are attached.

FIELD OF THE INVENTION

The present invention relates to exercise devices, and more particularly, to an exercise vest.

SUMMARY OF THE INVENTION

The general purpose of the present exercise vest, described subsequently in greater detail, is to provide an exercise vest which has many novel features that result in an exercise vest which is not anticipated, rendered obvious, suggested, or even implied by prior art, either alone or in combination thereof. To accomplish this, the present exercise vest is a personal portable exercise device provided to exercise and tone targeted muscles of the upper body. The present exercise vest includes a vest body. A front side of the vest body has a right portion, a left portion, a neck opening, a zippered gap continuously disposed between the right portion and the left portion in a position between a neck opening of the vest body and the bottom side of the vest body, and a shoulder portion engageable to the rear side proximal the top side to permit adjustment of the arm hole size. A vertical channel is continuously disposed between each of a pair of arm holes and the bottom side. A removable, washable liner is continuously disposed on the rear side on the interior side of the vest body.

A plurality of D-rings is strategically disposed on each of the front side and the rear side to exercise and tone targeted upper body muscles. A pair of length-adjustable chest straps is centrally disposed on the front side to further fasten and secure the right and left portions together in order to secure the vest body in proper position on the user's torso. At least one adjustable side strap is disposed across a vertical channel on each side to adjust the width of the vest body to a user's chest size. Exercise resistance bands interchangeably clip onto the D-rings to exercise and tone targeted muscles of the user's upper body. A belt slidingly engaging a plurality of belt loops secure the vest body in a proper position on the user and prevents the vest body from sliding upwardly during use.

The instance exercise vest is portable to permit exercise at any time or place regardless of the user's work schedule. In addition, the present exercise vest reduces or eliminates the costs associated with and the time traveling to a fitness center. The present exercise device can be also used while jogging to permit upper body and lower body exercises simultaneously. Thus has been broadly outlined the more important features of the present exercise vest so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
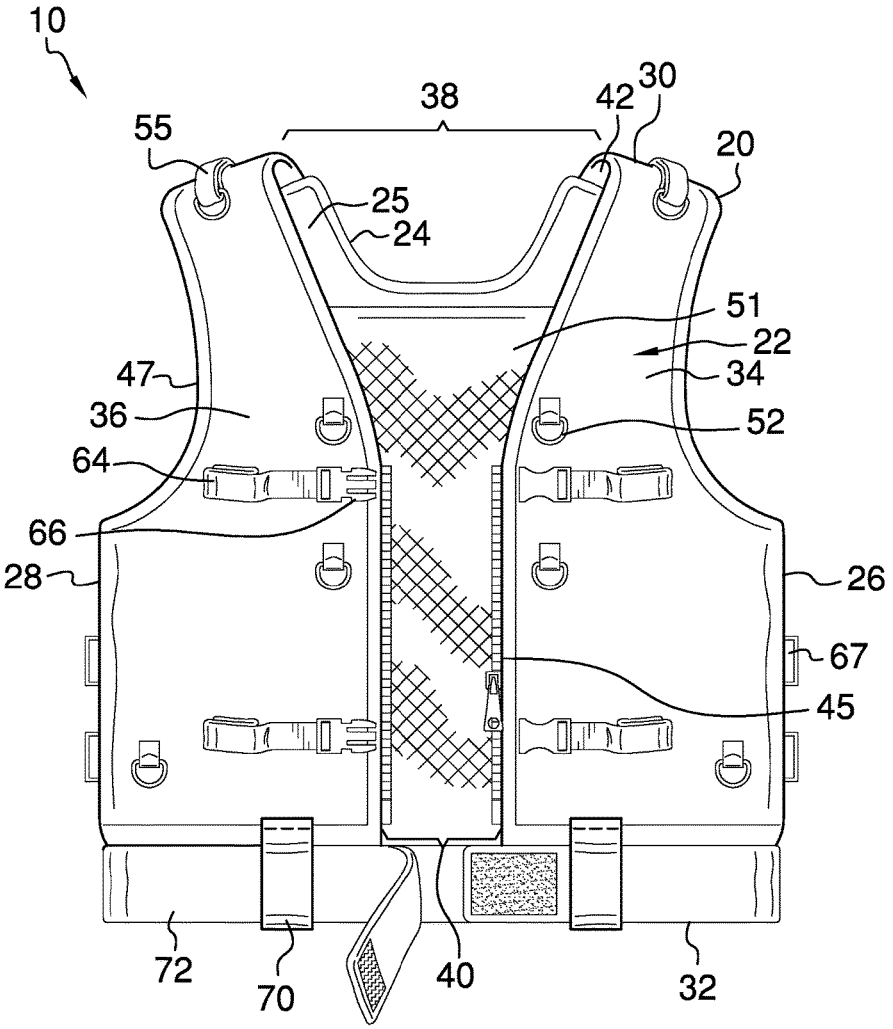
FIG. 1 is a front elevation view with a front side in an open condition.
Figure 2:
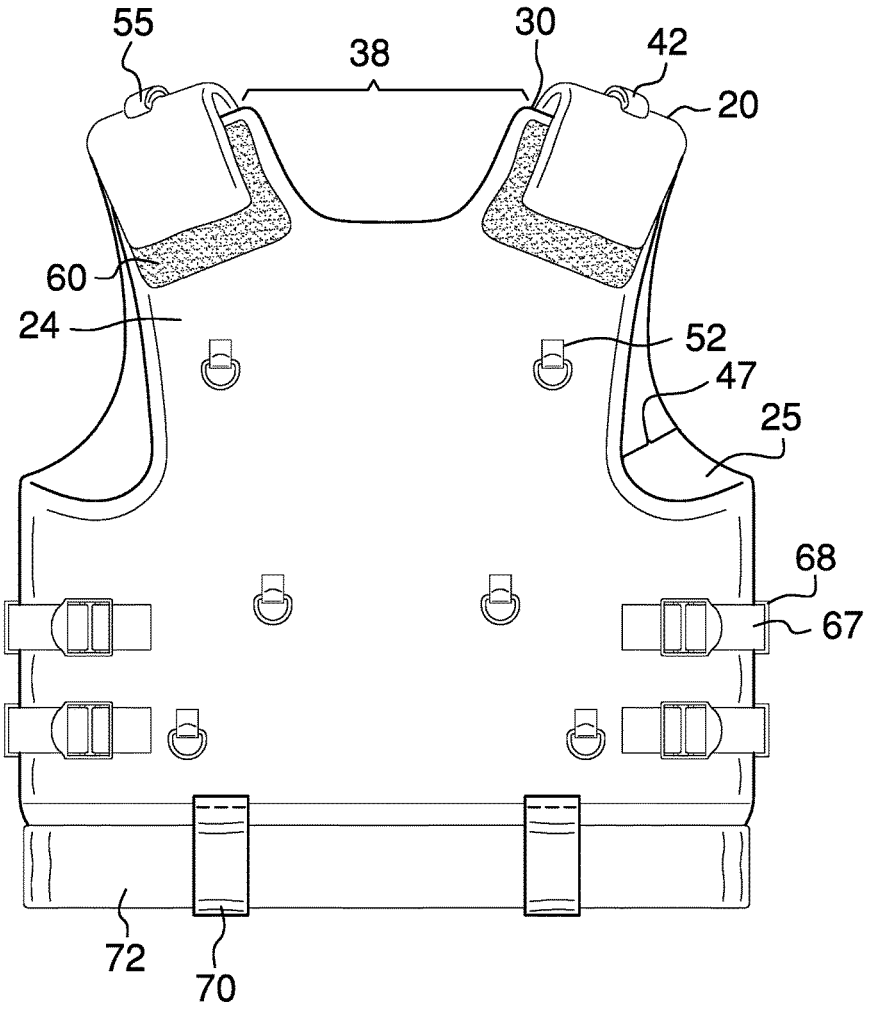
FIG. 2 is a rear elevation view.
Figure 3:
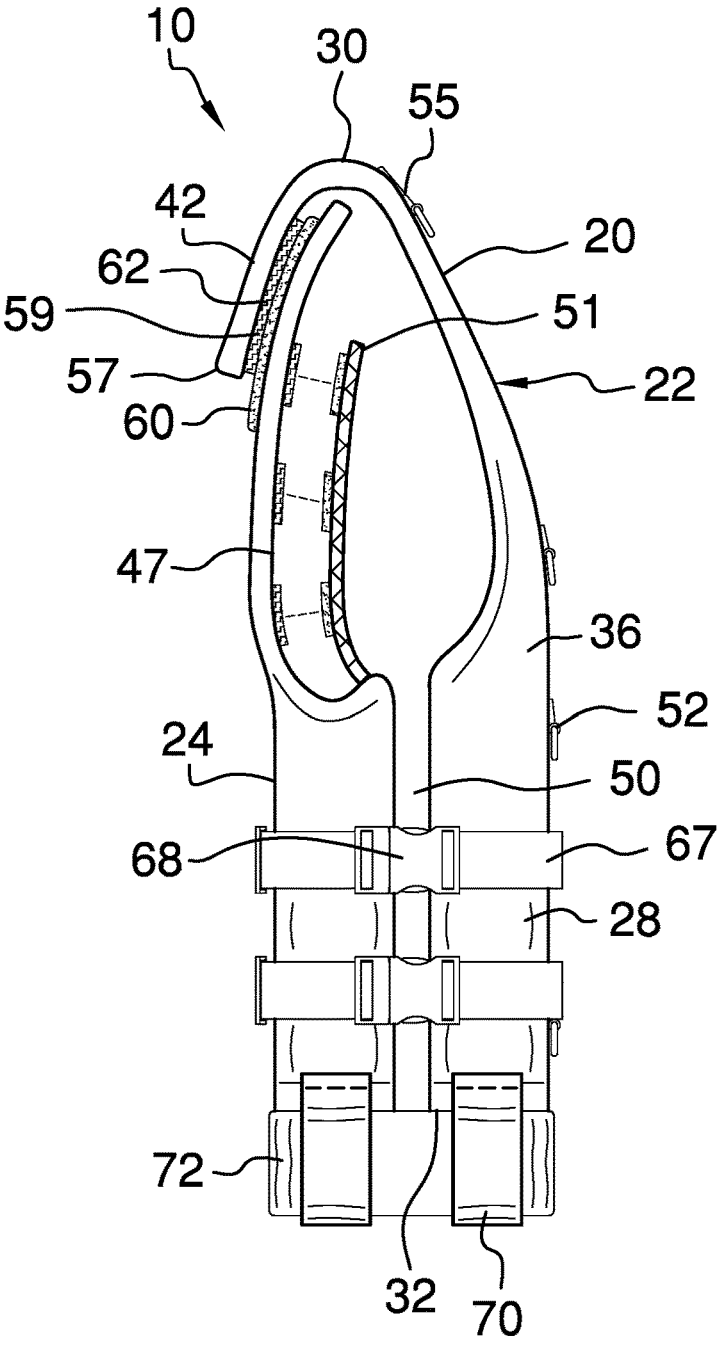
FIG. 3 is a left side elevation view showing a removable liner.
Figure 4:
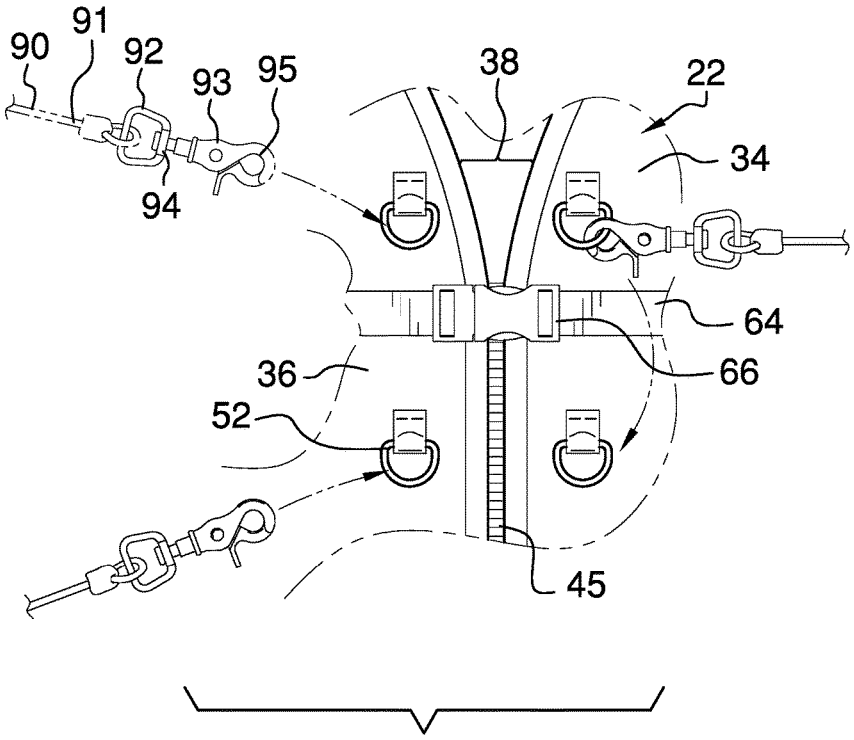
FIG. 4 is a detail view of the front side in a closed condition.
Figure 5:
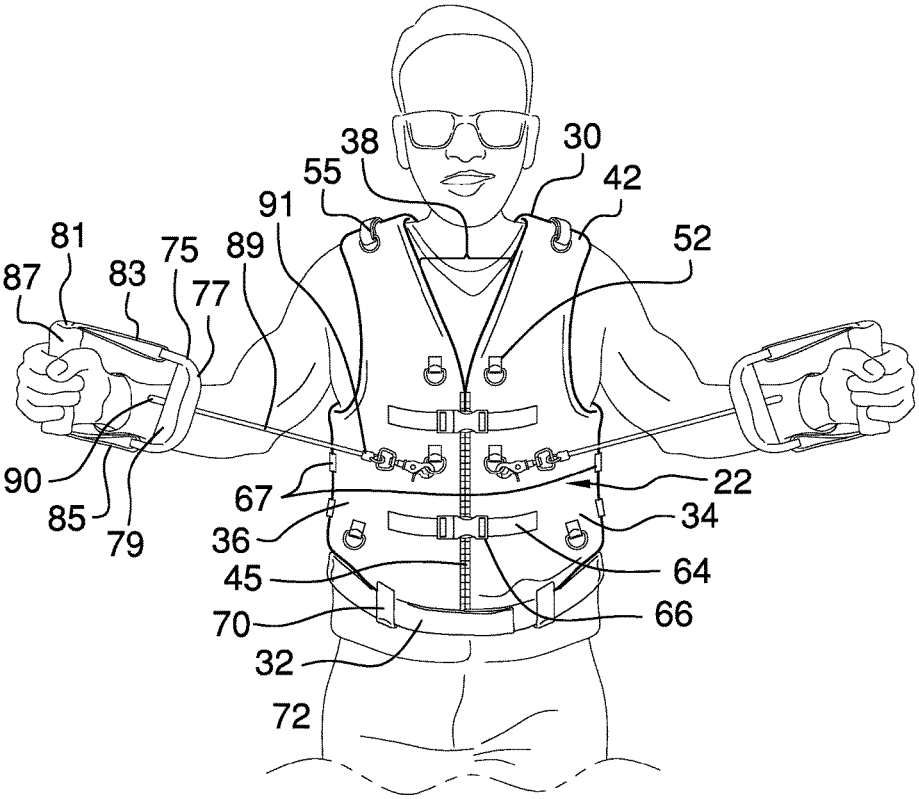
FIG. 5 is an in-use front view in the closed condition.

With reference now to the drawings, and in particular FIGS. 1 through 5 thereof, an example of the instant exercise vest employing the principles and concepts of the present exercise vest and generally designated by the reference number 10 will be described. Referring to FIGS. 1 through 5, the present exercise vest 10 is illustrated. The exercise vest 10 includes a vest body 20. The vest body 20 has a front side 22, a rear side 24, an interior side 25, a right side 26, a left side 28, a top side 30, and a bottom side 32. The front side 22 has a right portion 34, a left portion 36, a neck opening 38, a gap 40 continuously disposed between the right portion 34 and the left portion 36 in a position between the neck opening 38 and the bottom side 32, and a shoulder portion 42. A zipper 45 is continuously disposed along the gap 40 between the right portion 34 and the left portion 36. The zipper 45 is configured to attach the right portion 34 and the left portion 36 together. When the right portion 34 and the left portion 36 are zipped together, the vest body 20 is in a closed condition and, when the right and left portions 34, 36 are separated from each other, the vest body 20 is in an open condition. An arm hole 47 is disposed on each of the right side 26 and the left side 28 of the vest body 20 proximal the top side 30. A vertical channel 50 is continuously disposed between each arm hole 47 and the bottom side 32. A removable, washable liner 51 is continuously disposed on the rear side 24 on the interior side 25 of the vest body 20.

A plurality of D-rings 52 is disposed on each of the front side 22 and the rear side 24. The D-rings 52 on the front side 22 are disposed with one D-ring 52 on each of the right portion 34 and the left portion 36 proximal each of the top side 30, the gap 40 in a position proximal the neck opening 38, the bottom side 28 in a central position between the gap 40 and the respective right side 26 and left side 28. One of the D-rings 52 is disposed on the rear side 24 proximal each of the arm holes 47. One of the D-rings 52 is disposed on the rear side 24 proximal each of the right side 26 and the left side 28 in a position proximal the bottom side 32. A pair of the D-rings 52 is centrally disposed on the rear side 24 between the right and left sides 26, 28 in a central position between the arm holes 47 and the bottom side 32.

A shoulder strap 55 is disposed on each of the right portion and the left portion proximal the top side 30. Each shoulder strap 55 is engageable through the D-ring 52 disposed on the respective right portion 34 and left portion 36 proximal the top side 30. Each shoulder strap 55 has an outer end 57 and a first hook and loop fastener 59 disposed on the outer end 57. A second hook and loop fastener 60 is disposed on the rear side 24 proximal the top side 30. A third hook and loop fastener 62 disposed rearwardly on each shoulder portion 42 is engageable to the second hook and loop fastener 60 to permit adjustment of the size of each arm hole 47.

A pair of length-adjustable chest straps 64 is centrally disposed on the front side 22 across the gap 40 in a position parallel to each other and to the bottom side 32. A two-piece fastener clip 66 is centrally disposed on each chest strap to further fasten and secure the right portion 34 and the left portion 36 together. The chest straps 64 also secure the vest body 20 in proper position on the user's torso.

At least one adjustable side strap 67 is disposed across each vertical channel 50 in a position parallel to the bottom side 32 to permit the adjustment of the width of the vest body 20 to accommodate a range of users' chest sizes. A two-piece fastening clip 68 centrally disposed on each side strap 67.

A plurality of belt loops 70 is provided. A pair of the belt loops 70 is disposed proximal the bottom side 32 on the rear side 24. One of the belt loops 70 is disposed on each of the right portion 34, and the left portion 36. Each belt loop 70 is perpendicular to the bottom side 32. A belt 72 slidingly engages the belt loops 70 to secure the vest body 20 in a proper position on the user and to prevent the vest body 20 from sliding upwardly during use.

A plurality of fourth hook and loop fasteners 73 disposed on each of the rear side 24 on the interior side 25 of the vest body and on the liner 51 engage each other to permit the liner 51 to be removed and washed.

A pair of exercise resistance bands 75 is provided. Each exercise resistance band 75 has a rectangular frame 77. The frame 77 of each exercise resistance band 75 includes an inner segment 79, an outer segment 81, an upper segment 83 between the inner segment 79 and the outer segment 82, and a lower segment 85 between the inner segment 79 and the outer segment 81 in a position parallel to the upper segment 83. A cylindrical cushioned grip member 87 encircles the outer segment 81 of each frame 77. Each exercise resistance band 75 includes an elastomeric cord 89 having an internal end 90 attached to the inner segment 79 of the respective frame 77 and an external end 91. Each exercise resistance band 75 also includes a rectangular ring 92. The external end 91 of the respective cord 89 swivelingly attaches to the rectangular ring 92. An openable clip 93 has an attachment end 94 swivelingly attached to the rectangular ring 92 opposite the external end 91 and a clip portion 95 attachable to one of the D-rings 52. The exercise resistance bands 75 are strategically secured to the D-rings 52 to exercise and tone targeted muscles of the user's upper body. The elastomeric cord 89 of each exercise resistance band 75 has a length and a thickness to provide a resistance strength which is the resistance to stretching of the exercise resistance band 89. Each exercise resistance band 75 can be interchanged with a variety of resistance bands offering a wide range of resistance strengths in which a resistance member of the resistance band provides resistance to stretching dependent upon a length and a thickness of the resistance member. Each exercise resistance band 75 is interchangeable with one of the variety of resistance bands having a resistance member having a length and a thickness different from the length and the thickness of the exercise resistance band.

What is claimed is:

1. An exercise vest comprising:

a vest body having a front side, a rear side, a right side, a left side, a top side, and a bottom side, the front side having a right portion, a left portion, a neck opening, a gap continuously disposed between the right portion and the left portion between the neck opening and the bottom side, and a shoulder portion;

a zipper continuously disposed along the gap between the right portion and the left portion, wherein the zipper is configured to attach the right portion and the left portion together;

an arm hole disposed on each of the right side and the left side of the vest body proximal the top side;

a vertical channel continuously disposed between each arm hole and the bottom side;

a plurality of D-rings on each of the front side and the rear side, one of the plurality of D-rings being disposed on the front side on each of the right portion and the left portion proximal each of the top side, the gap in a position proximal the neck opening, and the bottom side in a central position between the gap and the respective right side and left side, one of the plurality of D-rings being disposed on the rear side proximal each of the arm holes, one of the plurality of D-rings being disposed on the rear side proximal each of the right side and the left side in a position proximal the bottom side, and a pair of the plurality of D-rings being centrally disposed on the rear side between the right and left sides in a central position between the arm holes and the bottom side;

a shoulder strap disposed on each of the right portion and the left portion proximal the top side, each shoulder strap having an outer end and a first hook and loop fastener disposed on the outer end, wherein each shoulder strap is engageable through the D-ring disposed on the respective right portion and left portion proximal the top side;

a second hook and loop fastener disposed on the rear side proximal the top side; a third hook and loop fastener disposed rearwardly on each shoulder portion, the third hook and loop fastener engageable to the second hook and loop fastener;

a pair of length-adjustable chest straps centrally disposed on the front side across the gap in a position parallel to each other and to the bottom side;

a two-piece fastener clip centrally disposed on each chest strap;

at least one length-adjustable side strap disposed across each vertical channel in a position parallel to the bottom side;

a two-piece fastening clip centrally disposed on each side strap; and a plurality of belt loops, one pair of the belt loops disposed proximal the bottom side on each of the rear side and one belt loop disposed on each of the right portion and the left portion, each belt loop perpendicular to the bottom side.

2. The exercise vest of claim 1 comprising a removable liner continuously disposed on the rear side on an interior side of the vest body; and a plurality of fourth hook and loop fasteners disposed on each of the rear side on the interior side of the vest body and on the liner.

3. The exercise vest of claim 1 comprising a pair of exercise resistance bands, each exercise resistance band having a rectangular frame, the frame of each exercise resistance band comprising:

an inner segment, an outer segment, an upper segment between the inner segment and the outer segment, and a lower segment between the inner segment and the outer segment in a position parallel to the upper segment;

a cylindrical cushioned grip member encircling the outer segment of each frame;

an elastomeric cord encircling the inner segment of each frame, each cord having an internal end attached to the inner segment of the respective frame and an external end;

a rectangular ring, the external end of the respective cord swivelingly attached to the rectangular ring; and an openable clip having an attachment end swivelingly attached to the rectangular ring opposite the external end and a clip portion attachable to one of the D-rings;

wherein each exercise resistance band is configured to provide resistance to stretching dependent upon a length and a thickness of the elastomeric cord.

4. The exercise vest of claim 3 wherein each exercise resistance band is interchangeable with a resistance band having an elastomeric cord having a length and a thickness different from the length and the thickness of the exercise resistance band.

5. The exercise vest of claim 1 comprising a belt slidingly engageable through the belt loops.

6. An exercise vest comprising:

a vest body having a front side, a rear side, a right side, a left side, a top side, and a bottom side, the front side having a right portion, a left portion, a neck opening, a gap continuously disposed between the right portion and the left portion between the neck opening and the bottom side, and a shoulder portion;

a zipper continuously disposed along the gap between the right portion and the left portion, wherein the zipper is configured to attach the right portion and the left portion together;

an arm hole disposed on each of the right side and the left side of the vest body proximal the top side;

a vertical channel continuously disposed between each arm hole and the bottom side;

a plurality of D-rings on each of the front side and the rear side, one of the D-rings being disposed on the front side on each of the right portion and the left portion proximal each of the top side, the gap in a position proximal the neck opening, and the bottom side in a central position between the gap and the respective right side and left side, one of the plurality of D-rings being disposed on the rear side proximal each of the arm holes, one of the plurality of D-rings being disposed on the rear side proximal each of the right side and the left side in a position proximal the bottom side, and a pair of the plurality of D-rings being centrally disposed on the rear side between the right and left sides in a central position between the arm holes and the bottom side;

a shoulder strap disposed on each of the right portion and the left portion proximal the top side, each shoulder strap having an outer end and a first hook and loop fastener disposed on the outer end, wherein each shoulder strap is engageable through one of the plurality of D-rings disposed on the respective right portion and left portion proximal the top side;

a second hook and loop fastener disposed on the rear side proximal the top side, the first hook and loop fastener slideable through one of the plurality of D-rings proximal the top side and engageable to the second hook and loop fastener;

a third hook and loop fastener disposed rearwardly on each shoulder portion, the third hook and loop fastener engageable to the second hook and loop fastener;

a pair of length-adjustable chest straps centrally disposed on the front side across the gap in a position parallel to each other and to the bottom side;

a two-piece fastener clip centrally disposed on each chest strap;

at least one length-adjustable side strap disposed across each vertical channel in a position parallel to the bottom side;

a two-piece fastening clip centrally disposed on each side strap;

a plurality of belt loops, one pair of the belt loops disposed proximal the bottom side on each of the rear side and one belt loop disposed on each of the right portion and the left portion, each belt loop perpendicular to the bottom side;

a pair of exercise resistance bands, each exercise resistance band having a rectangular frame, the frame of each exercise resistance band comprising:

an inner segment, an outer segment, an upper segment between the inner segment and the outer segment, and a lower segment between the inner segment and the outer segment in a position parallel to the upper segment;

a cylindrical cushioned grip member encircling the outer segment of each frame;

an elastomeric cord encircling the inner segment of each frame, each cord having an internal end attached to the inner segment of the respective frame and an external end;

a rectangular ring, the external end of the respective cord swivelingly attached to the rectangular ring;

an openable clip having an attachment end swivelingly attached to the rectangular ring opposite the external end and a clip portion attachable to one of the D-rings;

a removable, washable liner continuously disposed on the rear side on an interior side of the vest body; and a plurality of fourth hook and loop fasteners disposed on the interior side of the vest body and on the rear side of the liner, the fourth hook and loop fasteners on the vest body and on the liner being engageable to each other.

7. The exercise vest of claim 6 comprising a belt slidingly engageable through the belt loops.

* * * * *